US005477006A

United States Patent [19]

Imamiya et al.

[11] Patent Number: 5,477,006

[45] Date of Patent: Dec. 19, 1995

[54] DEVELOPING DEVICE HAVING DEVELOPING ROLLER AND CONDUCTIVE MEMBER

[75] Inventors: Koji Imamiya, Kawasaki; Toshiro Honda, Tokyo; Tamiko Nakajo, Yokohama; Shigenobu Osawa, Kawasaki, all of Japan

[73] Assignee: Kabushiki Kaisha Toshiba, Kawasaki, Japan

[21] Appl. No.: 319,481

[22] Filed: Oct. 7, 1994

Related U.S. Application Data

[63] Continuation of Ser. No. 31,306, Mar. 15, 1993, abandoned.

[30] Foreign Application Priority Data

May 29, 1992 [JP] Japan ..... 4-139009

[51] Int. Cl.[6] ..... G03G 15/08

[52] U.S. Cl. ..... 118/651; 355/261

[58] Field of Search ..... 355/259, 261, 355/251, 253; 118/651, 661, 656–658

[56] References Cited

U.S. PATENT DOCUMENTS

| | | | |
|---|---|---|---|
| 5,017,967 | 5/1991 | Koga | 355/261 |
| 5,057,871 | 10/1991 | Hirose et al. | 359/259 |
| 5,095,341 | 3/1992 | Yoshida et al. | 355/259 |
| 5,164,773 | 11/1992 | Nishio et al. | 355/245 |
| 5,168,312 | 12/1992 | Aoto et al. | 355/259 |
| 5,170,213 | 12/1992 | Yamaguchi et al. | 355/246 |
| 5,227,849 | 7/1993 | Katsumi et al. | 355/259 |

FOREIGN PATENT DOCUMENTS

| | | | |
|---|---|---|---|
| 0035159 | 4/1981 | Japan | 355/277 |
| 60-7790 | 2/1985 | Japan . | |

*Primary Examiner*—Robert Beatty
*Attorney, Agent, or Firm*—Foley & Lardner

[57] ABSTRACT

A developing device includes a developing roller and a conductive member. The rotatable image developing roller feeds a one-component toner to an image forming drum. The developing roller is in contact with the linearly shaped conductive member. A voltage is applied to the developing roller, while a second, higher voltage is applied to the conductive member. The two voltages are of the same polarity. This arrangement makes it possible to control component aggregation on the developing roller and eliminate any image/non-image potential difference on the image carrier.

12 Claims, 6 Drawing Sheets

DEVELOPING DEVICE HAVING DEVELOPING ROLLER AND CONDUCTIVE MEMBER

This application is a continuation of application Ser. No. 08/031,306, filed Mar. 15, 1993, now abandoned.

BACKGROUND OF THE INVENTION

1. Field of the Invention

The present invention relates to a developing device for developing an electrostatic latent image on an image carrier with a one-component developing agent and an image forming apparatus equipped with the developing device.

2. Description of the Related Art

As a developing device utilized for an electrophotographic apparatus and electrostatic recording apparatus to visualize an electrostatic latent image, a two-component developing system has currently been employed which magnetically feeds a two-component developing agent, that is, an agent composed of a colored particle called a toner and a magnetic particle called a carrier. It effects development, under an electrostatic force, with the agent attached to an electrostatic latent image.

In the two-component developing system, the developing device has the drawback of being bulkier and complicated, and there is a need to control the toner/carrier mixed ratio. The recent major trends in small type copiers and small printers has been toward the use of a one-component developing system requiring no carrier.

Of these developing devices, a developing device using a one-component non-magnetic developing agent does not need an expensive magnet roller as a developing agent holding member, thus readily achieving a compact, light-weight and low-cost unit.

For an elastic roller made up of a developing agent holding member, it is possible that, even if the developing agent holding member is set in contact with an image carrier, it causes no injury to the image carrier. Hence an associated developing electrode can be placed nearer the electrostatic latent image. It is, therefore, possible to improve the sharpness of character and line images and to effect development of high image quality.

In spite of such advantages, when feeding is effected with the developing agent formed, as a thin layer, on the surface of the developing agent holding member, a print pattern hysteresis prominently emerges due to a charge difference between a printed and a nonprinted area at those previous printing times, causing an adverse effect on an image at the subsequent developing time.

Further, the feeding of the developing agent has to be effected under those physical and electrostatic forces across the developing agent and the developing agent holding member and, when continuous printing is performed, there occurs a drop in holding power of the developing agent, thus causing the flying of the developing agent and the contamination of the developing device.

The conventional developing device using a one-component-based developing agent is compact, light in weight and low in cost, but it involves a drop in quality of an image caused by a print pattern hysteresis built up at a previous copying cycle as well as the flying, etc., of the developing agent upon copying in a continuous mode.

SUMMARY OF THE INVENTION

It is accordingly the object of the present invention to provide a developing device and image forming apparatus which are compact, light in weight and low in cost, and which can obtain a high image quality, even in a continuous mode, without flying of the developing agent.

A developing device is provided for developing an electrostatic latent image on an image carrier with the use of a one component-based developing agent, comprising:

a rotatable developing agent holding member having a shaft, an elastic layer formed around the shaft and a surface conductive layer formed on the elastic layer and having an electrical resistance and arranged in a confronting relation to a to-be-imaged area on the image carrier to feed the developing agent to the to-be-imaged area on the image carrier, in which a resistance between the shaft and the surface conductive layer is below $1\times10^9\ \Omega$;

means for applying a bias voltage to the shaft of the developing agent holding member;

a conductive member set in contact with the surface of the developing agent holding member; and means for applying a voltage greater than the bias voltage to the conductive member with the same polarity as the bias voltage.

According to the developing device of the present invention, with the developing agent holding member rotatable in a manner to feed the one-component developing agent to the imaging area the conductive member is set in contact. A voltage is applied to the conductive member at a level greater than that of, and with the same polarity as that of, the developing agent holding member. By so doing it is possible to control the extent of density with which the developing agent is distributed on the developing agent holding member and to achieve the uniformity of the charge on the developing agent through the elimination of a charge difference between the imaging area and the non-imaging area. It is thus possible to achieve better development free from the flying of the developing agent even in a continuous copying mode and free from any previous print pattern hysteresis.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

One embodiment of the present invention will be explained below with reference to the accompanying drawings.

Figure 1:
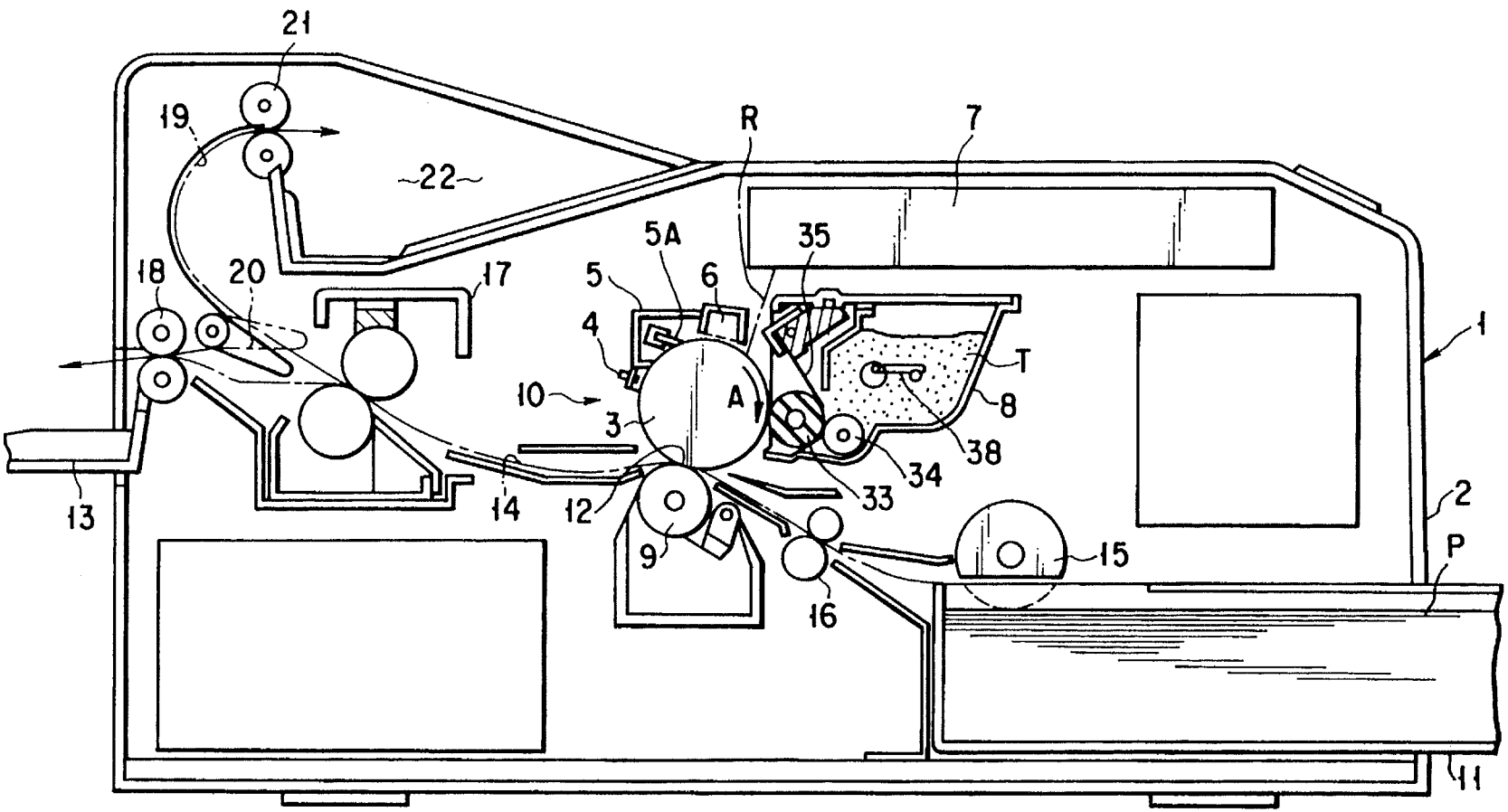
FIG. 1 is a front view schematically showing an inner arrangement of an image forming apparatus according to one embodiment of the present invention.

FIG. 1 shows an arrangement of an image forming apparatus 1 of the cleanerless process type.

In FIG. 1, a photosensitive drum 3 is provided, as an image carrier, at a substantially middle zone of an image forming apparatus body 2 such that the drum is rotatable in a direction as indicated by an arrow A in FIG. 1. The photosensitive drum 3 is made of a photoconductive material, such as an organic photoconductor (OPC), and has such a diameter as to have a circumferential length smaller than the length of an image to be recorded.

An eraser lamp 4 serving as a discharging means having such a function as will be set out below, a nonpatterning device 5 serving as a means for nonpatterning a residual toner left after transfer, a scorotron charger 6 as a charging means, a laser device 7 serving as an electrostatic latent image forming means, a contacting type one-component developing unit 8 serving as a developing/cleaning means and a transfer roller 9 serving as a transfer means are arranged around, and sequentially along a rotation direction of, the photosensitive drum 3. An image forming means 10 is provided for forming a toner image T1 (see FIG. 2), as a developing agent image, on the outer peripheral surface of the photosensitive drum 3.

A sheet conveying path 14 is formed in the apparatus body 2 to enable a sheet P (a to-be-transferred material) which is taken out of a supply cassette 11 on one side of the apparatus body 2 to be carried toward a discharge tray 13 on the other side of the apparatus body 2 via an image transfer section 12 situated between the transfer roller 9 and the photosensitive drum 3 of the image forming means 10. Upstream of the image transfer section 12 on the sheet conveying path 14 a pair of aligning rollers 16 are arranged for the sheet which is taken out of the supply cassette 11 via a supply roller 15 to be fed into the image transfer section 12 at a proper timing after the sheet has its leading edge aligned. A fixing device 17 for fixing a toner image TI transferred to the sheet P and pair of discharge rollers 18 for discharging the fixed sheet P into a discharge tray 13 are provided downstream side of the image transfer section 12.

A gate 20 is provided between the fixing device 17 and the paired discharge rollers 18 to guide the sheet p which is fixed at the fixing device 17 onto an inverting conveying path 19 as required.

The sheet P which is guided onto the inverting conveying path 19 is discharged via a pair of discharge rollers 21 into a discharge section 22 with its image-bearing surface down, the discharge section 22 being located as a recess provided on the top side of the apparatus body 2.

The image forming operation of the image forming apparatus thus arranged will be explained in more detail below.

The photosensitive drum 3 is rotated in a direction as indicated by an arrow A in FIG. 1 and the outer periphery of the photosensitive drum 3 is substantially uniformly charger by the scorotron charge 6. Then, a laser beam R is emitted by the laser device 7 to a negatively charged area on the drum 3 in accordance with image information to be recorded. By this beam exposure, an electrostatic latent image is formed on the surface of the photosensitive drum 3. The electrostatic latent image is brought in a confronting relation to the developing device 8 as the photosensitive drum is rotated.

A developing roller 33 starts its rotation with a layer of a toner T formed thereon as a triboelectrically charged agent, that is, a one-component-based developing agent and the toner T is deposited on the electrostatic latent image on the photosensitive drum 3 to provide a toner image TI in which case the toner T is deposited on a beam exposed area, that is, a reversal development is carried out. The toner T has an average particle size of about 8 to 15 μm. The toner T is charged to an extent of about −5 to −30 −30 μc/g, through the friction of the developing roller 33 against a blade 35.

The toner image TI, after being developed, is conveyed to the transfer area, where it confronts the transfer roller 9. On the other hand, a sheet P is picked up from the sheet cassette 11 with the rotation of the supply roller 15 and sent via the paired aligning rollers 16 to the transfer area in synchronization with the drum 3.

The sheet P thus sent has its rear surface positively charged by the transfer roller 9. As a result, the toner image TI on the surface of the photosensitive drum 3 is electrostatically attracted to the sheet P.

In a contacting type transfer means, a stable transfer characteristic is exhibited even under a very humid environment and an amount of residual toner after transfer is decreased, thus alleviating a cleaning burden. It is also possible to eliminate paper dust originating from the sheet P and prevent it from being mixed with the toner T.

After the transfer, the developing roller 33 and toner transfer roller 34 are stopped until another image forming operation is started.

The sheet P, after transfer, is transferred to the fixing device 17 where the toner is melted under heat and pressure and fixed on the sheet P. Then the fixed sheet is delivered for discharge.

After transfer, any residual toner T, though being somewhat slight, and residual positive and negative electrostatic latent images, stay on the surface of the photosensitive drum 3.

The toner T and electrostatic latent images, after having its negative latent image erased by the erasure lamp 4, are transferred to the nonpatterning device 5 where they are disturbed and nonpatterned.

The nonpatterning device 5 has a conductive brush 5A made of a fiber, such as Treca and Kynol (trade names), an electrical resistance of $10^3$ to $10^9$ Ωcm. The conductive brush 5A is set in contact with the photosensitive drum 3 and is connected to a bias power source, not shown, such that a voltage of 200 to 1500 volts is applied to the brush 5A.

with the rotation of the photosensitive drum 3, the residual toner T or electrostatic latent image on the photosensitive drum 3 is sequentially brought in frictional contact with the conductive brush 5A and, by so doing, temporarily attracted there.

Much of the residual toner T left after transfer is negatively charged and attracted to the conductive brush 5A. Of the residual toner on the non-image-forming area on the drum, some is positively charged and passes through the conductive brush 5A without being attracted, but it poses no problem because an amount of such residual toner involved is very slight.

The residual toner T trapped on the conductive brush 5A after transfer has been made is temporarily injected within a time corresponding to the conditions of a bias voltage applied, resistance of the conductive brush 5A, particle size and resistance of the toner, and so on. In this way, the trapped toner is returned back to the photosensitive drum 3 under an electric field created between the conductive brush 5A and the photosensitive drum 3. The returned toner T on the drum 3 has a positive polarity opposite to a normal polarity and, when the photosensitive drum 3 is charged by the scorotron charger 6, bathed in a negative corona. As a result, the toner T is negatively charged and cleaned by the developing device 8.

On the other hand, the disturbed area is then moved to a charging position confronting the scorotron charger 6 where it is corona-charged.

After corona charge, an electrostatic latent image is formed by the laser device 7 on the photosensitive drum and again reaches the developing/cleaning position confronting the developing device 8.

In the subsequent electrostatic latent image formation process, any residual toner is, in addition to being largely decreased by the roller transfer operation, also substantially uniformly and adequately thinnly scattered on those exposed and non-exposed areas (corresponding to imaging and non-imaging areas, respectively) of the photosensitive drum 3, thus producing no uneven distribution of the toner on the drum. That is, even in the second developing cycle, any residual toner after exposure is made uniform on the drum, thus obtaining a uniform toner image.

Here, the developing roller 33 is set in contact with the photosensitive drum 3, while providing a given nip (contact width) relative to the drum so as to enhance its cleaning capability. In this case, a developing bias voltage is applied at a level intermediate between a residual potential on the exposed area and a potential on the non-exposed area. By so doing, a fresh toner T is deposited from the developing roller 33 to the exposed area and, at the same time, at the nonexposed area, the toner T is sequentially attracted to the developing device 8, because an attraction force under the developing bias voltage exceeds that on the photosensitive drum 3, and is collected.

In this way, the photosensitive drum 3 is multiply rotated to obtain a single recorded copy. A toner image TI, after being developed and cleaned, is transferred to the sheet p at a location confronting the transfer roller 9. In this way, a similar operation is repeated as set out above.

The arrangement of the contacting type one-component developing device 8 of the present invention will be explained in more detail below with reference to FIGS. 2, 3 and 4.

Figure 2:
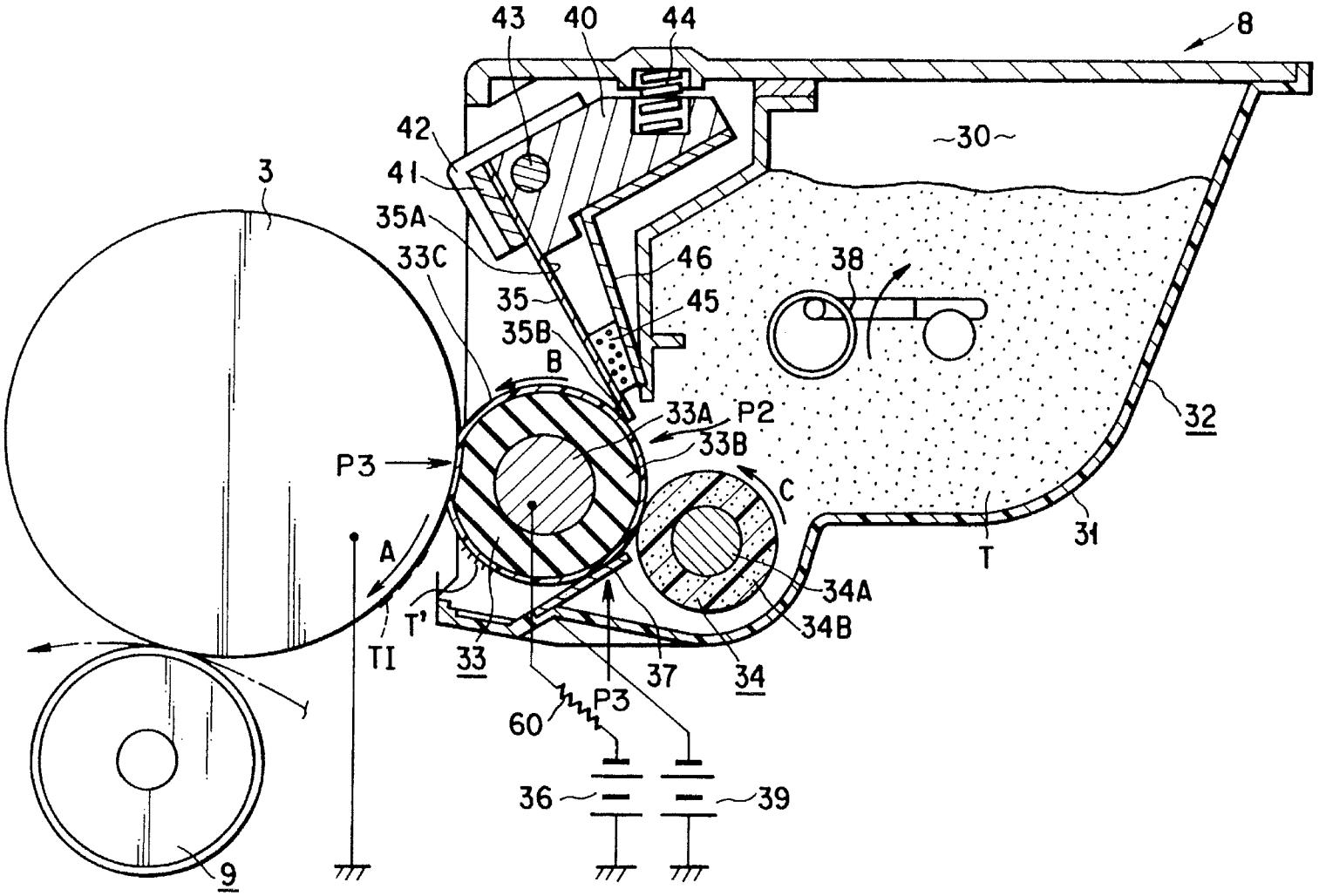
FIG. 2 is a cross-sectional view schematically showing the arrangement of the embodiment of the present invention.

FIG. 2 is a cross-sectional view showing the developing device 8.

The developing device 8 has a developing device body 32 integral with a toner hopper 31 serving as a toner storage section 30 and hence a developing agent storage section.

The device body 32 is opened at a zone facing the photosensitive drum 3. The developing roller 33 is provided as a developing agent carrier and located in the neighborhood of that opening of the device body. The developing roller 33 is elastically set relative to, and in contact with, the photosensitive drum 3, while providing a given nip through deformation, such that the developing roller 33 is rotated in a "with" direction (an arrow B direction) relative to the direction in which the drum 3 is rotated.

The toner transfer roller 34 is provided at the back of the developing roller 33 in a bottom area of the toner storage section 30 and allows transfer of the toner T, that is, a non-magnetic one-component developing agent, to and from the developing roller 33.

According to the present invention, the developing roller 33 and toner transfer roller 34 are stopped at a standby time before an image forming operation and at each print-to-print (copy-to-copy) time.

Within the device body 32 the blade 35 is provided, as a developing agent (toner T) layer forming means, above the developing roller 33 to restrict an amount of toner supplied by the developing roller 33 and to form a thin toner layer.

A recovery blade 37 formed of a conductive member is arranged at a location downstream of a to-be-imaged area as viewed in a rotation direction of the developing roller 33.

Within the toner storage section 30 a mixer 38 is provided as an agitating means to agitate the toner T. The non-magnetic toner T in the toner hopper 31 is fed to the toner transfer roller 34, while being agitated by the mixer 38, and from there to the developing roller 33. The toner transfer roller 34 is set in contact with the developing roller 33 and, at that contacting area, is frictionally rotated relative to the developing roller 33. The roller 34 not only supplies the toner but also serves to scrape some of that residual toner off the developing roller 33.

According to the present invention, reversal development is employed in which a negatively charged, organic photosensitive drum 3 is used and toner T is negatively charged.

Further, the developing roller 33 is of such a developing type that it is set in contact with the photosensitive drum 3. The roller 33 has elasticity and surface smoothness and needs to have a resistance having a proper resistance value across the metal shaft 33A.

Figure 3:
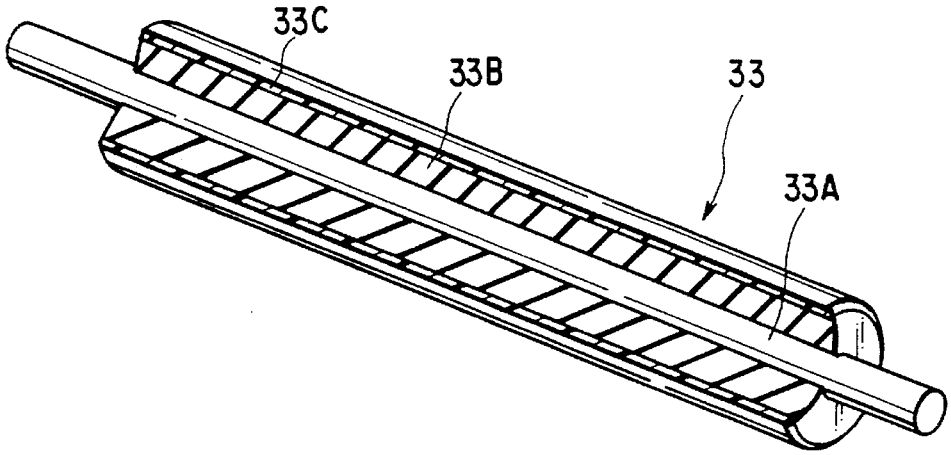
FIG. 3 is a perspective view, partly in cross-section, showing a developing roller in the embodiment shown in FIG. 2.

As shown in FIGS. 2 and 3, therefore, the roller 33 is formed as an elastic roller, comprising, in addition to the metal shaft 33A, an elastic layer 33B and surface conductive layer 33C sequentially formed around the metal shaft 33A in which the surface conductive layer 33C has an electrical resistance and a resistance between the shaft 33A and the surface conductive layer 33C is below $1\times10^9$ Ω.

The rubber hardness of the elastic layer 33B is 15 to 40 degrees and the rubber hardness, including the surface conductive layer 33C, is desirably in a range of 20 to 50 degrees. Further, the surface smoothness is desirably below 7 $\mu m_{RZ}$ in terms of the surface roughness and the contact width (developing nip) as set out above is about 0.5 to 4 mm at which the developing roller 33 is set in contact with the drum.

Taking the above into consideration, as the elastic layer 33B use is made of silicon rubber having a rubber hardness of 25 degrees, an elongation of about 425% and a resistive value of about $5\times10^3$ μcm and, as the surface conductive layer 33C, use is made of a conductive polyurethane surface coating material (available under the trade name of Sparex manufactured by Japanese Miractran Co., Ltd.) having a resistance of $5\times10^3$ μcm and an elongation of about 353% to provide an about 70 μm-thick surface layer. As a result, the developing roller 33 thus formed has about a 30 degree elongation and a resistance between the metal shaft 33A and the surface conductive layer 33C of about 100 kΩ, and a surface roughness of about 3 μm.

Further, a DC power source 36 is connected as a voltage application means to the metal shaft 33A of the developing roller 33 via a protective resistance 60 of 100 k to 50 M and a bias voltage of about −200 V is applied to the developing roller relative to the surface potential of −550 V of the photosensitive drum 3.

The recovery blade 37 is formed of a thin-sheet elastic phosphor bronze coated with a Toshiba-made conductive carbon black-filled silicone rubber. The blade 37 is connected at its base end to the device body 32 and has a free other end, so that the blade is urged against and over a whole length of the developing roller 33 as the developing agent carrier. The urging force is about 3 g/cm$^2$.

A DC power source 39 is connected as a voltage application means to the recovery blade 37. A potential with the same polarity as that of, and an absolute value greater than that of, the developing roller 33 is applied to the recovery blade, that is, a potential −320 V the same as that of the toner transfer roller 34, is applied to the recovery blade 37.

The toner transfer roller 34 comprises a metal shaft 34A and a soft expanded polyurethane foam layer 34B provided around the metal shaft 34A and having an electroconductive property. The roller 34 is rotated in an "against" direction (the direction of an arrow C) relative to the direction in which the developing roller 33 is rotated. The roller 34 serves to supply the toner T and to prevent the agglomeration of the toner T above the bottom area of the hopper 31. A bias voltage the same as that of the developing roller 33 is applied to the toner transfer roller 34 by a voltage applying means, not shown, thus ensuring better movement of the toner T.

The toner blade 35 for toner layer formation is held by a first blade holder 40, spacer 41 and second blade holder 42. The first blade holder 40 is rotatable around a shaft 43 and normally urged by a plurality of compression springs 44 in a predetermined direction. The spring constant of the compression spring 44 is smaller than that of a thin sheet spring material of the toner layer formation blade 35 and, even if being worn at the contacting section of the blade 35, results in almost no change in compression force, thus maintaining a stable layer formation capability over an extended period of time. In this embodiment, the compression force of the toner layer formation blade 35 against the developing roller 33 is about 80 g/cm$^2$.

An expanded material 45, such as MOLTOPREN (BAYER), is attached to the back surface of the blade 35 and set in contact with a baffle plate 46 attached to the first blade holder 40 so that the vibration of the blade 35 is suppressed to enable a better toner layer to be formed.

Figure 4:
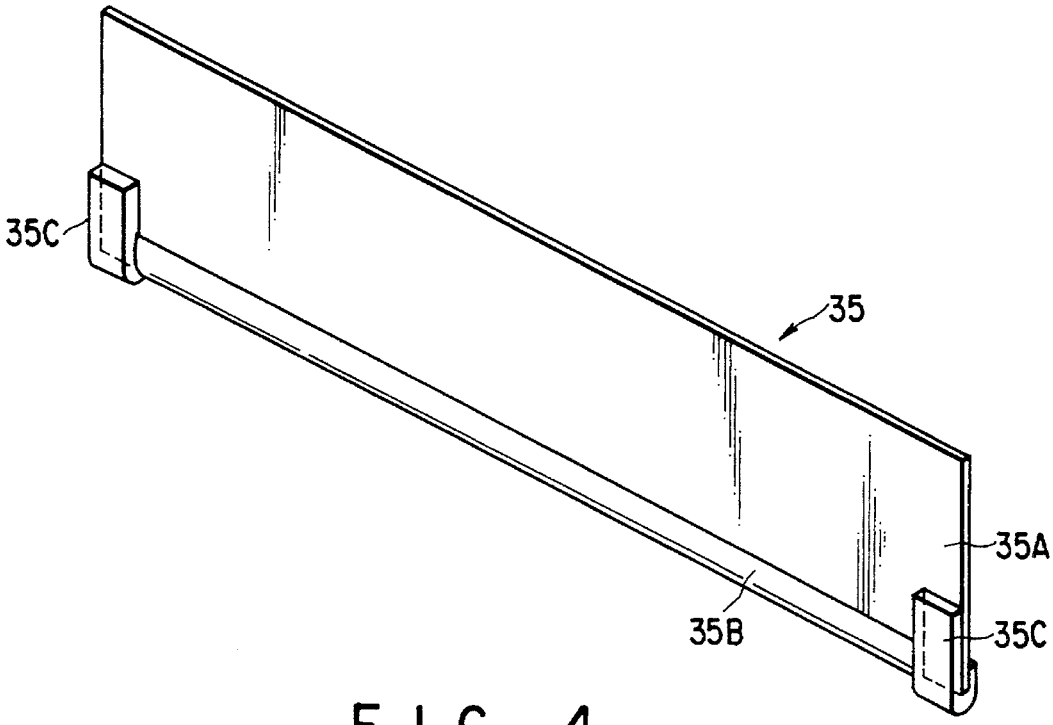
FIG. 4 is a perspective view of the blade shown in FIG. 2.

As shown in FIG. 4, the toner layer formation blade 35 comprises a thin-plate spring member 35A, such as phosphor bronze, and a tip 35B joined to the forward end of the spring member 35A over substantially the whole length and made of an elastic rubber material, such as a silicone rubber and urethane, or a resin. The tip 35B is semispherical in cross-section and the semispherical area of the tip 35B is pressed with a given load against the developing roller 33 and the toner T triboelectrically passed therebetween enables a proper layer of the toner T to be formed while being negatively charged with the same polarity as that of the drum 3.

A pair of sealing member 35C, 35C are provided one at each end of the toner layer blade 35.

The toner T fed by the toner transfer roller 34 onto the developing roller 33 is triboelectrically charged on the developing roller 33 and sent to the toner formation blade 35 under an electrostatic force as well as a physical force.

The toner T on the developing roller 33 is triboelectrically charged, while being restricted in the amount fed to the photosensitive drum 3 as an adequately charged and uniformly distributed layer.

The residual toner T' staying on the developing roller 33 after development has been made is passed through the recovery blade 37 and returned back into the device body 32.

Tests were conducted with the developing device 8 incorporated into an apparatus (page printer TN-7300 by Toshiba).

EXAMPLE 1

As the photosensitive drum 3 use was made of a negatively-charged type organic photosensitive drum, 60 mm in diameter, whose process speed was 72 mm/sec. The developing roller 33 has a rotational peripheral speed of 144 mm/sec and a double the peripheral speed ratio relative to the photosensitive drum 3. As the toner use was made of a negative-polarity toner with a carbon, wax, charge controlling agent, etc., dispersed in a styreneacrylic resin.

Under these conditions, 10,000 copies were obtained and, in this case, flying of the toner was not present.

Control 1

Tests were conducted under the same conditions as those in Example 1 except that, as the material of the recovery blade 37, Mylar (polyethyleneterephthalate) was employed.

Figure 5:
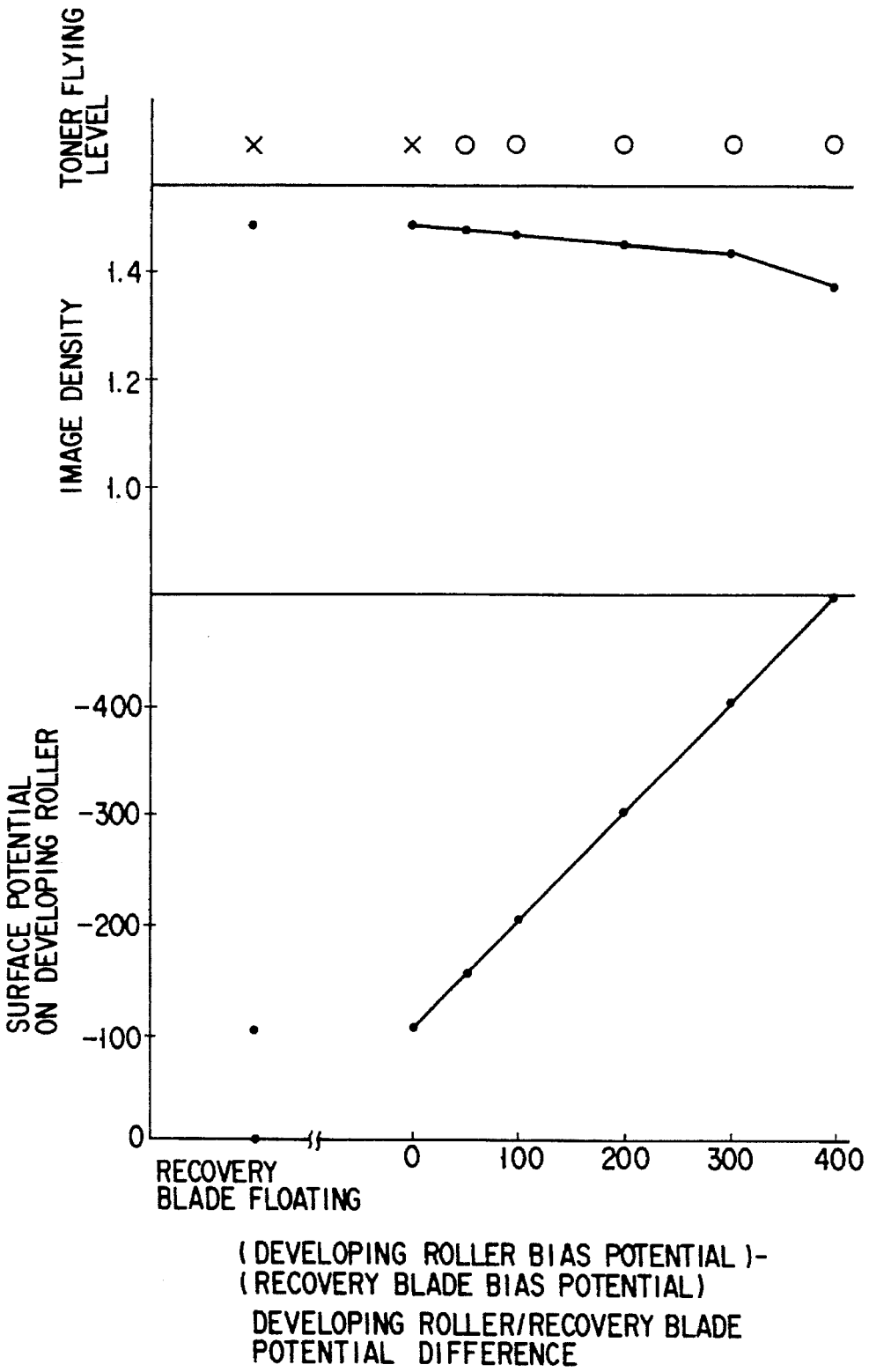
FIG. 5 is an explanatory view showing the relation of a potential difference of the developing roller and recovery blade to a surface potential on the developing roller.

After 10,000 copies were obtained, the toner T was found flying in a worse state and, throughout the length of the developing roller 33, the developing device 8 involved the blowing of the toner T. In order to verify the advantage of Example 1 over Control 1, the toner surface potential on the developing roller 33 was measured using the application voltage of the recovery blade 37 as a parameter. The result is shown in FIG. 5.

When the recovery blade 37 was placed in an electrically floating state, the toner surface potential on the developing roller 33 was, though being about −100 V, increased with the increasing application voltage. This is because the toner T is electrostatically polarized under an electric field across the developing roller 33 and the recovery blade 37 and hence a maxwell force is produced. It is considered that the toner T is hard to separate off the developing roller 33 under such a force and a better effect acts upon the toner T so that the flying of the toner is prevented. If, however, a larger potential difference is involved across the developing roller 33 and the recovery blade 37, an adverse effect acts on the developing characteristic, thus lowering an image density.

Further, the flying level of the toner T is improved from a roller (33)-to-blade (37) potential difference of above 50 V and, Judging from the overall point of view, such a potential difference is optimal in a range of 50 to 300 V.

EXAMPLE 2

Tests were carried out under the same conditions as those in Example 1 except that the resistance of the developing roller 33 was varied and the results were reviewed.

Regulating the resistive value of the elastic layer 33B of the developing roller and that of the conductive polyurethane surface coating material of the surface conductive layer 33C, samples were manufactured for those shaft (33A)-to-surface conductive layer (33C) resistances of $10^3$ Ω, $10^5$ Ω, $10^9$ Ω and $10^{11}$ Ω.

With a voltage applied to the metal shaft 33A a resistive value was measured relative to a thin foil electrode attached to the surface of the surface conductive layer 33C as given below:

measuring apparatus . . . WP-6B Wheatstone bridge manufactured by Andow Electric Company Ltd.

electrode surface . . . 1 $cm^2$

Using the aforementioned developing roller 33 tests were made under the same conditions as in Example 1. 10,000 copies were obtained for the sample using the developing roller 33 whose resistive value was $1\times10^{11}$ Ω. The toner was found flying in a worse state as in the case of Control and it was found that, throughout the length of the developing roller 33, the toner T is blown out of the developing device 8.

The phenomenon is such that an increase in the resistance of the developing roller 33 shows a tendency of the developing roller's surface potential to approach a latent image potential. For an ordinary pattern with a larger white (non-image area) background, an effective bias potential rises due to an effect by the white latent image background. As a result, the conductive blade application voltage difference is decreased, failing to gain the advantage of the present invention.

Figure 6:
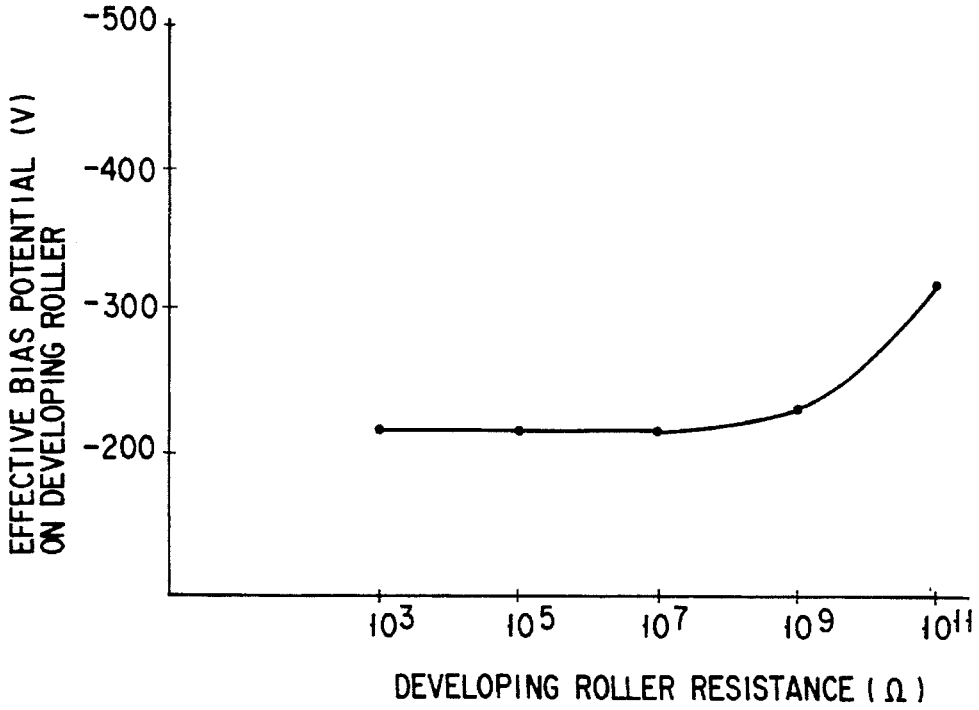
FIG. 6 is an explanatory view showing the relation of the resistance of the developing roller to an effective bias potential on the developing roller.

As shown in FIG. 6, the effective bias voltage of the developing roller 33 was measured using the shaft (33A)-to-conductive layer (33C) resistance as a parameter.

With the surface potential of the photosensitive drum 3 placed at −550 V and the developing bias voltage at −220 V, the effective bias voltage was measured under the condition that the apparatus was driven in a non-imaged white print state. As shown in FIG. 6, it has been found that the effective bias voltage on the developing roller 33 rises with the increasing resistance of the developing roller 33.

Figure 7:
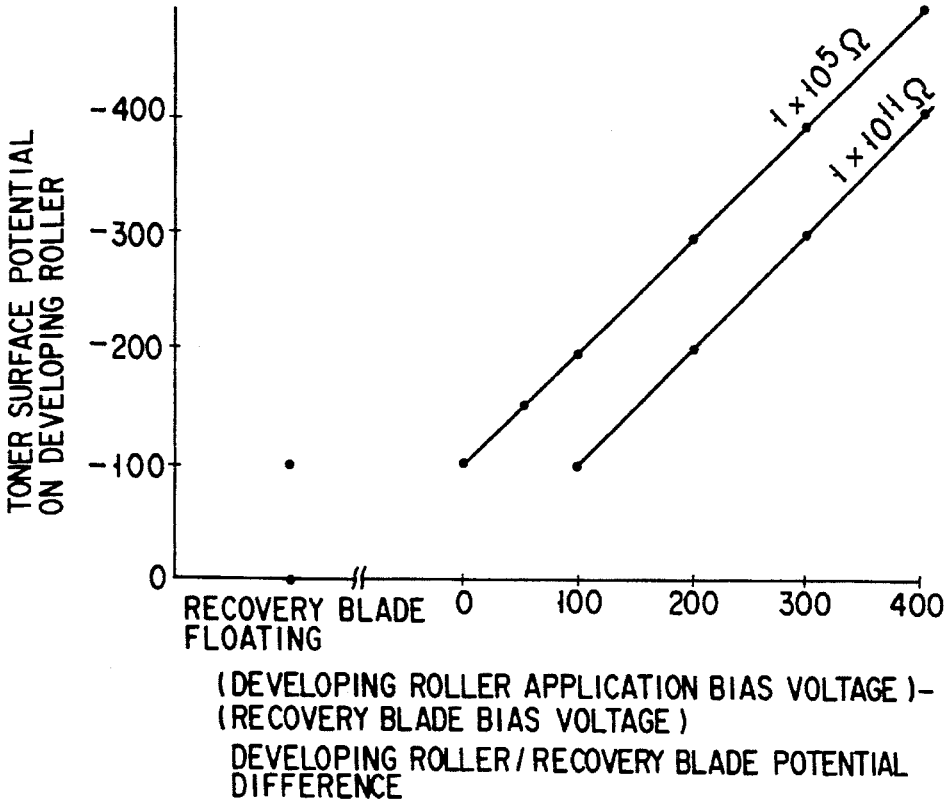
FIG. 7 is an explanatory view showing the relation of a potential difference of the developing roller and recovery blade to a toner surface potential on the developing roller.

As will be seen from FIG. 7, the toner surface potential on the developing roller against a potential difference across the application bias potential on the developing roller and the potential on the recovery blade shows a loss of 100 V for the developing roller 33 of $1\times10^{11}$ Ω compared with the developing roller of $1\times10^5$ Ω. This corresponds to the effective bias voltage variation level for the developing roller 33 of $1\times10^{11}$ Ω.

It has been found that, in order to gain the advantage of the present invention, it is necessary to make the developing roller at a resistive value of below $10^9$ Ω.

With the developing device 8, the developing roller 33 and toner transfer roller 34 are stopped at the standby time before the image formation operation and at a copy-to-copy (sheet-to-sheet interval) time whereby a stress time in which the toner T and blades 35, 37 suffer from a stress, per copy, through their frictional contact can be reduced, thus alleviating the degeneration of the toner T and blades 35, 37. It is thus possible to extend the service life of these component parts.

Figure 8:
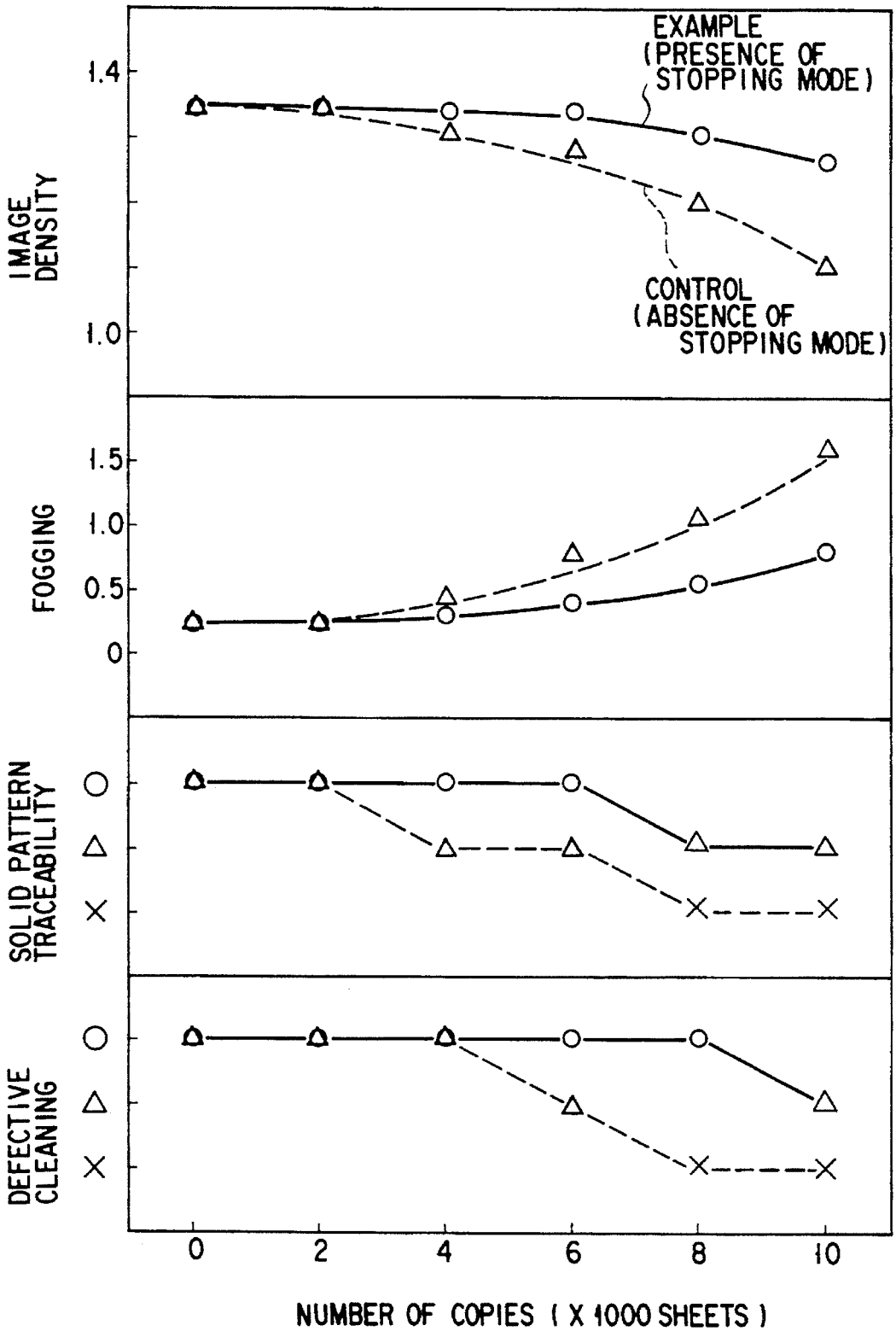
FIG. 8 is an explanatory view showing a comparison between the case where there is a roller stopping mode and the case where there is no image stopping mode, that is, a comparison in an image quality variation when a sheet is fed past the associated roller.

FIG. 8 shows a comparison between the case where there is a roller stopping mode for the developing roller 33 and toner transfer roller 34 and the case where there is no roller stopping mode for the conventional apparatus (Control), that is, a comparison in image quality variation upon the passage of the sheet through the associated rollers. In Control, an abrupt drop in image quality was observed after 8,000 copies were made, while, according to the experiment example, less image quality was observed even after 10,000 copies were obtained and the developing device showed the extended service life. In FIG. 8, the symbols 0, Δ and X represent the states of image quality corresponding to "good", "fair" and "bad", respectively.

As an experiment example, tests were conducted under the same conditions as those of Example 1 except that the recovery blade 37 was made up of a 0.125 mm thick Mylar (polyethyleneterephthalate one, the tip 35B of the toner layer formation blade 35 was made of conductive carbon black-filled silicone rubber manufactured by Toshiba Silicone Co., Ltd, the DC power source 39 was connected to the phosphor blade plate 35A and a voltage, that is, −3200 V, was applied with the same polarity as that of, and an absolute value exceeding that of, the developing roller 33. As in Example 1, it was possible to, after 10,000 copies were obtained, gain a better result free from the flying of the toner T.

Although in the aforementioned embodiment explanation has been made in conjunction with the non-magnetic contacting type one-component development, the present invention can be applied to those developing systems having no magnet in the developing roller, such as a non-contacting developing system and contacting developing system utilizing no elastic roller.

Even in the case where a toner contains magnetic particles, the present invention can be applied thereto unless the toner is fed through the utilization of a magnet.

Further, the developing mode (normal and reversal), structure and toner are not within the range of the present invention and the known one or ones may be utilized.

The present invention is not restricted thereto and can variously changed or modified without departing from the spirit and scope of the present invention.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A developing apparatus for developing a latent image on an image carrier with a developing agent, comprising:

storing means for storing the developing agent, the storing means having an opening portion for supplying the developing agent therefrom;

a developing roller, opposed to the image carrier, for transferring the developing agent in a predetermined transfer direction and applying the developing agent to the image carrier to develop the latent image on the image carrier, which is rotated in a rotating direction corresponding to the predetermined transfer direction;

a supplying roller for supplying the developing agent stored in the storing means to the developing roller through the opening portion;

means, arranged upstream in the transfer direction with respect to the image carrier and contacting the developing roller, for restricting a thickness of the developing agent supplied on the developing roller;

a conductive member, arranged downstream of the location at which the developing roller applies the developing agent to the image carrier and contacting the developing roller, for charging any residual developing agent which is unused when developing the latent image and which is transferred by the developing roller;

first voltage applying means for applying a first voltage to the developing roller; and second voltage applying means for applying a second voltage to the conductive member, the absolute value of the second voltage being greater than the absolute value of the first voltage.

2. A developing apparatus according to claim 1, wherein the developing agent is a one component type.

3. A developing apparatus according to claim 1, wherein the developing roller has a structure which includes a shaft, an elastic layer formed around the shaft and a conductive layer formed on the elastic layer, in which an electrical resistance between the shaft and the conductive layer is below $1\times10^9$ Ω.

4. The developing apparatus according to claim 1, wherein the conductive member is a blade formed of a thin elastic sheet of phosphor bronze, and having a fixed end and a free end, the blade being set in elastic contact with the full length of the developing roller.

5. The developing apparatus according to claim 1, wherein the conductive member is a blade which exerts an elastic pressure against the developing roller of about 3 $g/cm^2$.

6. The developing apparatus according to claim 1, wherein the conductive member is a blade of a thin elastic sheet of phosphor bronze coated with a conductive carbon black-filled silicone rubber.

7. The developing apparatus of claim 1, wherein said first voltage and said second voltage are of the same polarity.

8. The developing apparatus according to claim 1, wherein the developing roller is stopped at a standby time before an image forming operation and at a print-to-print, copy-to-copy, time in a continuous image mode.

9. The developing apparatus according to claim 1, wherein the developing roller has a surface conductive layer hardness in a range of 20 to 50 degrees and an elastic layer hardness between 15 and 40 degrees.

10. The developing apparatus according to claim 1, wherein the first voltage applying means comprises a DC power source connected to a shaft of the developing roller via a protective resistance of 100 KΩ to 50 MΩ.

11. The developing apparatus according to claim 1, wherein the first voltage applying means applies a bias voltage of about −200 V relative to a surface potential of about −550 V on the image carrier.

12. The developing apparatus according to claim 1, wherein the conductive member is a blade of a thin elastic sheet of phosphor bronze coated with a conductive carbon black-filled silicone rubber and has a fixed end and a free end, the blade being set in elastic contact with the full length of the developing roller.

* * * * *